US005307862A

United States Patent [19]

Sakata et al.

[11] Patent Number: 5,307,862

[45] Date of Patent: May 3, 1994

[54] ADJUSTABLE MOLD FOR CONTINUOUS CASTING OF ARTICLES OF DIFFERENT THICKNESSES

[75] Inventors: Yutaka Sakata; Takashi Asari, both of Niihama, Japan

[73] Assignee: Sumitomo Heavy Industries, Ltd., Tokyo, Japan

[21] Appl. No.: 14,270

[22] Filed: Feb. 5, 1993

Related U.S. Application Data

[63] Continuation-in-part of Ser. No. 913,313, Jul. 15, 1992, abandoned.

[30] Foreign Application Priority Data

Oct. 25, 1991 [JP] Japan ..... 3-095438

[51] Int. Cl.[5] ..... B22D 11/04

[52] U.S. Cl. ..... 164/436; 164/491

[58] Field of Search ..... 164/436, 491

[56] References Cited

U.S. PATENT DOCUMENTS

| | | | |
|---|---|---|---|
| 3,292,216 | 12/1966 | Colombo | 164/436 |
| 3,735,801 | 5/1973 | Bunkhardt | 164/436 |
| 3,926,244 | 12/1975 | Meier | 164/491 |
| 4,506,724 | 3/1985 | Vial | 164/436 |
| 4,789,021 | 12/1988 | Ahrens | 164/436 |

FOREIGN PATENT DOCUMENTS

| | | | |
|---|---|---|---|
| 1323952 | 3/1963 | France | 164/436 |

*Primary Examiner*—Paula A. Bradley
*Assistant Examiner*—James Miner
*Attorney, Agent, or Firm*—Nikaido, Marmelstein, Murray & Oram

[57] ABSTRACT

Lateral frames of the disclosed mold can be replaced easily and rapidly without disassembling a continuous casting machine, so as to improve the operational efficiency and to reduce the cost. The mold comprises a fixed longitudinal frame and a movable longitudinal frame which can be opened/closed by remote control, and a pair of fixed lateral frame members to which variable lateral frame members securely joined with lateral copper plates are detachably attached. A bracket provided on each of the variable lateral frame members is brought into engagement with a bracket receiving recess formed in each of the fixed lateral frame members in order to position the lower end portions of the lateral frame members. After that, the upper end portions of them are securely fixed by clamping means. Thus, the lateral frame members are integrally joined so that a mold cooling water supply/drain pipe and a spray water supply pipe for a foot shoe are connected to water conduits in the variable lateral frame member. In this manner, replacement of the lateral frames having a size corresponding to a desired thickness of cast pieces can be achieved.

7 Claims, 12 Drawing Sheets

ADJUSTABLE MOLD FOR CONTINUOUS CASTING OF ARTICLES OF DIFFERENT THICKNESSES

CROSS REFERENCE TO RELATED APPLICATION

This is a continuation in part of patent application Ser. No. 07/913,313 filed on Jul. 15, 1992, now abandoned.

BACKGROUND OF THE INVENTION

1. Industrial Field of the Invention

The present invention relates to an improvement of an adjustable mold for continuous casting of articles of different thicknesses.

2. Description of the Prior Art

As a technique concerning a so-called article thickness variable mold for continuous casting in which the mold cavity is selectively defined to have a desired thickness by replacing only lateral frames held between longitudinal frames, there has conventionally been known a mold, for example, disclosed in Japanese Utility Model Unexamined Publication No. 62-72749. In this example, one of the longitudinal frames constituting the mold is fixed, and the other free longitudinal frame opposite to the fixed one is movably attached to the fixed longitudinal frame. Lateral frames of a size corresponding to a desired thickness of a cast piece are replaceably held between those two longitudinal frames. Frame cooling water supply/drain pipes associated with the respective lateral frames are replaceably connected to opposite ends of the free longitudinal frame.

With the conventional mold for continuous casting, however, the whole lateral frames must be detached from their transfer devices in a narrow space on the machine, and this operation not only takes much labor but also is dangerous. In actual practice, therefore, the whole mold is removed from the machine and transferred to a workshop, and then, the lateral frames are replaced by new lateral frames for a desired article thickness. In such a method, it takes a long time to change the mold size. Also, various kinds of molds for replacement which have sizes corresponding to predetermined thicknesses of cast pieces may be prepared in advance so as to use one of them to replace the mold every time the cast piece thickness is changed. However, this arrangement is extremely disadvantageous in respect of cost reduction because expenses for its equipment are high.

Taking the problems of the above-described conventional technique into consideration, the present invention has an object to enable quick replacement of lateral frames without disassembling the machine, thus improving the operational efficiency and reducing the cost.

SUMMARY OF THE INVENTION

One aspect of the present invention provides an adjustable mold for continuous casting of articles of different thickness, comprising a fixed longitudinal frame, a movable longitudinal frame which is movable in the lateral direction with respect to said fixed longitudinal frame, a pair of lateral frames which are held between said fixed longitudinal frame and said movable longitudinal frame and located opposite to each other, each said lateral frame consisting of a fixed lateral frame member and a variable lateral frame member detachably attached on said fixed lateral frame member in surface contact relation with the latter, a device for moving each said fixed lateral frame member in the longitudinal direction, a bracket provided on one of said fixed lateral frame member and said variable lateral frame member to project from a lower portion of its contact surface, a bracket receiving recess formed in a lower portion of the contact surface of the other of said fixed lateral frame member and said variable lateral frame member to receive said bracket in engagement therewith, a projecting block located at an upper portion of the contact surface of said variable lateral frame member and having a first coupling portion, a slide block provided o said fixed lateral frame member and having a second coupling portion to be coupled with said first coupling portion of said projecting block, a piston connected to an end of a tie rod, the other end of which is connected to said slide block, hydraulic driving apparatus for pressing and moving said slide block toward said variable lateral frame member, and a spring device for biasing said tie rod in such a direction that said slide block is urged away from said variable lateral frame member.

Moreover, another aspect of the present invention provides an adjustable mold for continuous casting of articles of different thickness, comprising a fixed longitudinal frame, a movable longitudinal frame which is movable in the lateral direction with respect to said fixed longitudinal frame, a pair of lateral frames which are held between said fixed longitudinal frame and said movable longitudinal frame and located opposite to each other, each said lateral frame consisting of a fixed lateral frame member and a variable lateral frame member detachably attached on said fixed lateral frame member and securing thereon a lateral copper plate, a projecting block fixedly provided at an upper portion of said variable lateral frame member and having a first coupling portion, a slide block provided on said fixed lateral frame member and having a second coupling portion to be coupled with said first coupling portion of said projecting block, a hydraulically driven piston connected to an end of a tie rod, the other end of which is connected to said slide block, for pressing and moving said slide block toward said variable lateral frame member, a spring device for always biasing said tie rod in such a direction that said slide block is urged away from said variable lateral frame member, a claw securely fixed to said variable lateral frame member at a lower portion thereof, a drawing plate provided on said fixed lateral frame member to be movable toward and away from said fixed lateral frame member and adapted to be engaged by said claw, a second spring device for always urging said drawing plate toward said fixed lateral frame member, and a second hydraulically driven piston for pressing said drawing plate against said second spring device.

DETAILED DESCRIPTION OF THE INVENTION

Figure 1:
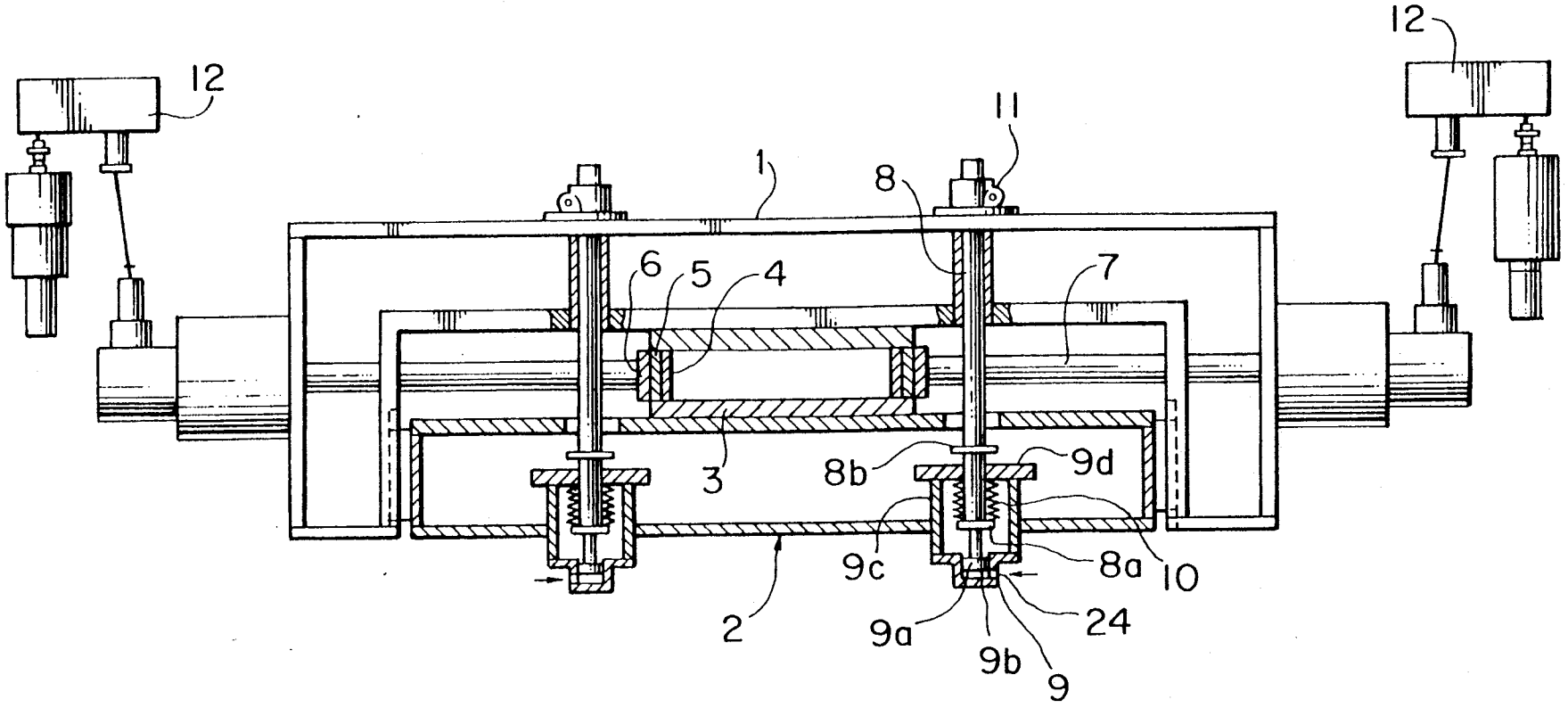
FIG. 1 is a view showing an entire structure of an adjustable mold for continuous casting of articles of different thicknesses according to the present invention.
Figure 2:
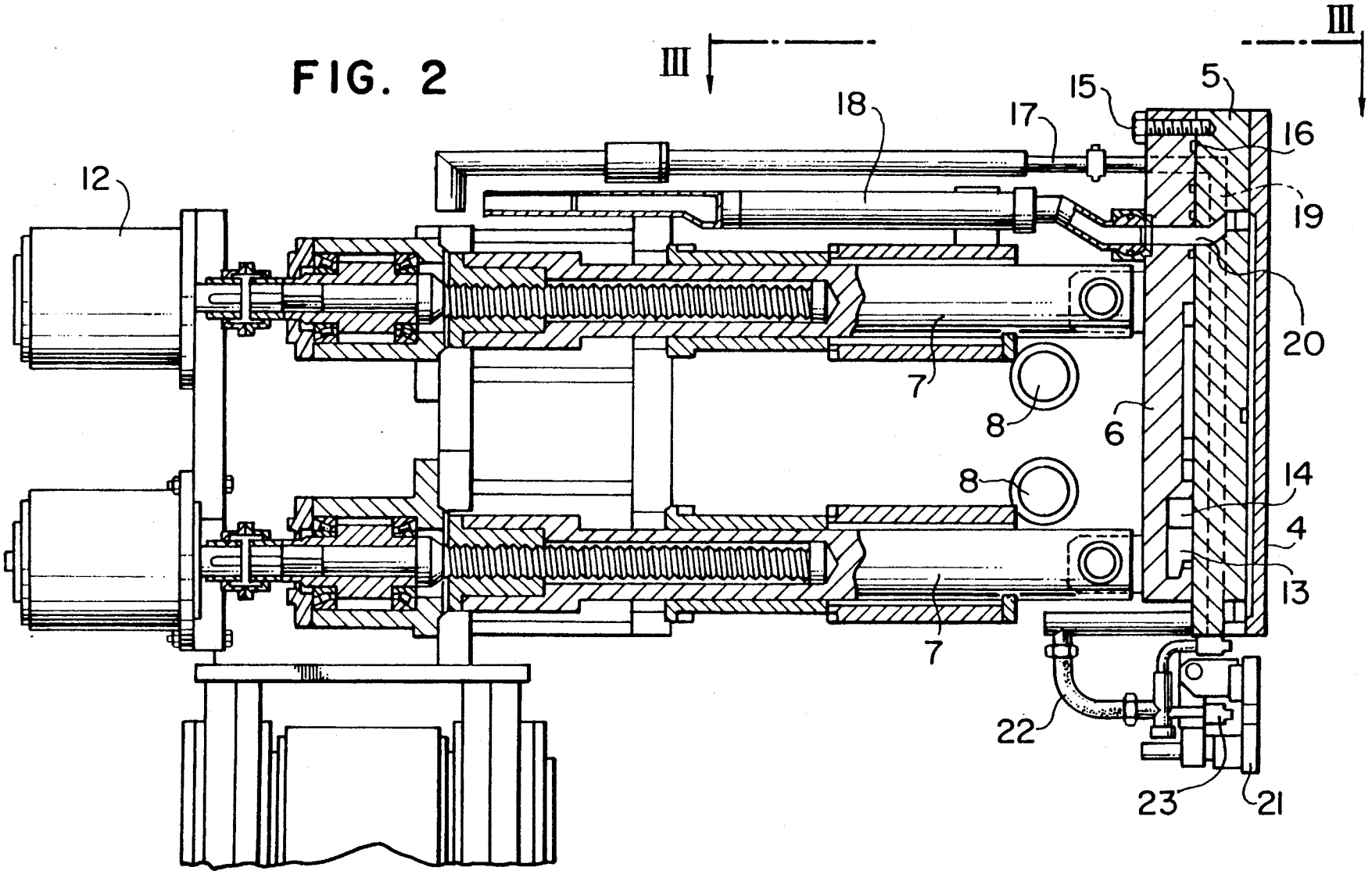
FIG. 2 is a cross-sectional view showing a first embodiment of the invention in which a variable lateral frame member is secured on a fixed lateral frame member.
Figure 3:
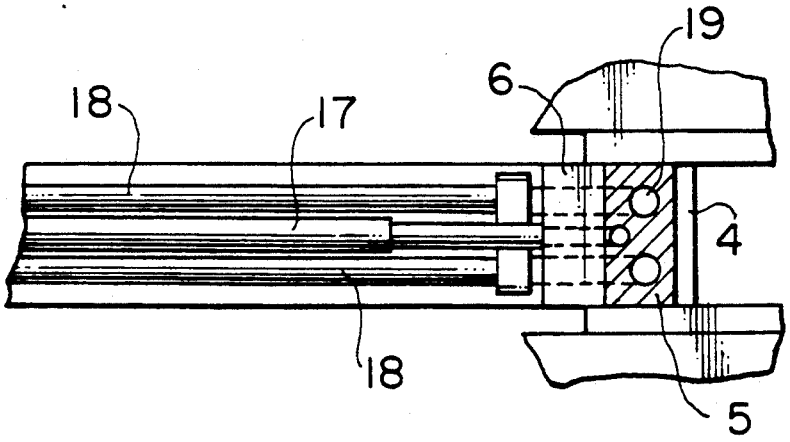
FIG. 3 is a partial plan view taken along the line III—III of FIG. 2.
Figure 4:
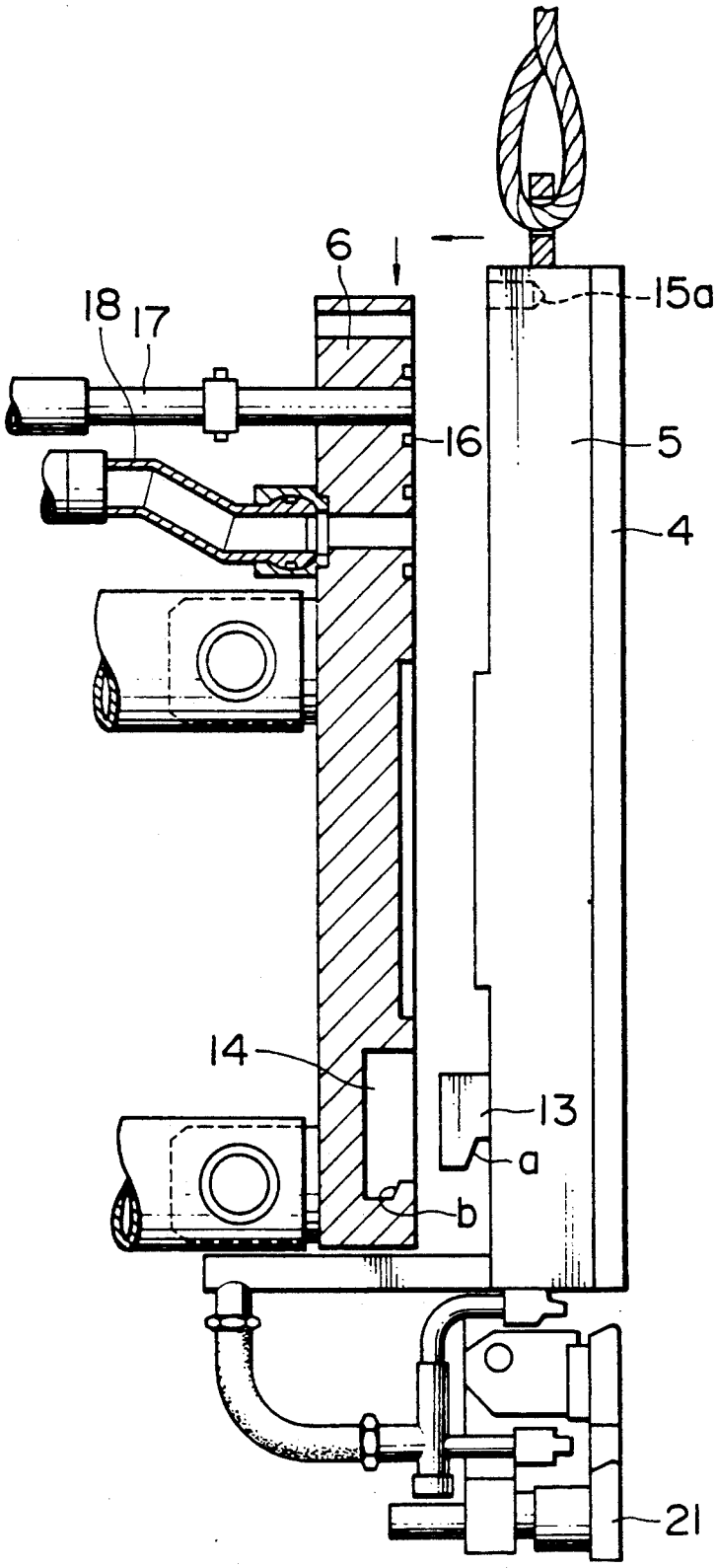
FIG. 4 is a view showing the first embodiment of the invention in which the variable lateral frame member is to be secured on the fixed lateral frame member.

FIG. 1 is a schematic view showing an entire structure of a mold according to the present invention. FIGS. 2 to 4 show a first embodiment of the invention: FIG. 2 is a cross-sectional view of a lateral frame; FIG. 3 is a partial plan view of the lateral frame; and FIG. 4 is a view showing an assembling condition of a fixed lateral frame member and a variable lateral frame member.

In FIGS. 1 to 4, reference numeral 1 denotes a fixed longitudinal frame; and 2 denotes a movable longitudinal frame opposite to the fixed longitudinal frame 1. A longitudinal copper plate 3 is provided inside of each of the fixed longitudinal frame 1 and the movable longitudinal frame 2. A pair of lateral copper plates 4 are held between the longitudinal copper plates 3 in such a manner that the longitudinal copper plates 3 and the lateral copper plates 4 define a molding cavity. Variable lateral frame members 5 securely hold the lateral copper plates 4, and fixed lateral frame members 6 are located on the outer sides of the variable lateral frame members 5. Each of the variable lateral frame members 5 is detachably attached on the fixed lateral frame member 6. It should be noted that the word "variable" is employed in the sense of "replaceable" in the following explanation.

Spindles 7 for moving the lateral frames are driven by driving apparatus 12.

Tie rods 8 are provided extending through the fixed longitudinal frame 1 and the movable longitudinal frame 2 which are opposite to each other. One end of each of the tie rods 8 can be moved in and out by remote control of a worm jack 11 for adjusting the tie rod length which is provided on the outer side of the fixed longitudinal frame 1. Therefore, the distance between the fixed longitudinal frame 1 and the movable longitudinal frame 2 can be controlled by the worm jacks 11. Hydraulic cylinders may be provided in place of these worm jacks. On the other end of the tie rod 8, there is attached a piston 9*a* which is a component part of a plunger device 9 for releasing clamping force which is installed in the movable longitudinal frame 2. The piston 9*a* is closely fitted in a plunger chamber 9*b* which is another part of the plunger device 9 and formed in the outer end portion of a casing 9*c* provided in the movable longitudinal frame 2. Inside of the casing 9*c*, a clamp spring 10 is provided between an end cover 9*d* of the casing 9*c* and a flange 8*a* formed on the tie rod 8. Also, the tie rod 8 is formed with a stepped portion 8*b* outside of the casing 9*c*. The stepped portion 8*b* serves as a stopper when it is brought into contact with the end cover 9*d* of the casing 9*c* although it is not always necessary.

Positioning brackets 13 are provided on the lower portions of the variable lateral frame members 5. Each of the brackets 13 is projected toward the fixed lateral frame member 6 and formed with a taper surface a at the bottom. Bracket receiving recesses 14 are provided in the lower portions of the fixed lateral frame members 6. Each of the bracket receiving recesses 14 is a concave portion in which the bracket 13 can be inserted, and is formed with a taper surface b at the bottom. Consequently, when the brackets 13 are inserted into the bracket receiving recesses 14 and the variable lateral frame members 5 are moved down, the taper surfaces a and b are slid and brought into contact with each other to thereby position the variable lateral frame members 5 and the fixed lateral frame members 6 accurately.

Fixing bolt means 15 serve to secure the variable lateral frame members 5 on the fixed lateral frame members 6. Each of the fixing bolt means 15 is forcibly inserted in a bolt hole 15*a* so that the variable lateral frame member 5 is secured on the fixed lateral frame member 6. There are also provided sealing O-rings 16, spray water pipes 17, supply/drain pipes 18 of mold cooling water, water conduits 19 formed in the variable lateral frame members 5, slit-like water conduits 20 formed between the lateral copper plates 4 and the variable lateral frame members 5, foot shoes 21, spray water hoses 22, and nozzles 23.

FIG. 4 illustrates a condition just before the variable lateral frame member 5 is attached on the fixed lateral frame member 6. First, as shown in FIG. 4, the variable lateral frame member 5 is hung with a rope, and the positioning bracket 13 provided on the frame member 5 is inserted into the bracket receiving recess 14 formed in the fixed lateral frame member 6 so as to perform positioning of the lower portion of the frame member 5. After that, the bolt means 15 is fitted and tightened into the bolt hole 15*a* formed in the upper portion of the frame member 5. Thus, the fixed lateral frame member 6 and the variable lateral frame member 5 are integrally joined as shown in FIG. 2. A gap between the variable lateral frame member 5 and the fixed lateral frame member 6 is sealed by the O-ring 16. The mold cooling water supply/drain pipe 18 and the spray water pipe 17 are connected with the water conduits 19 and 20 provided in the variable lateral frame member 5 so that the lateral copper plate 4 is cooled by cooling water passing through the water conduits 19 and 20.

Figure 5:
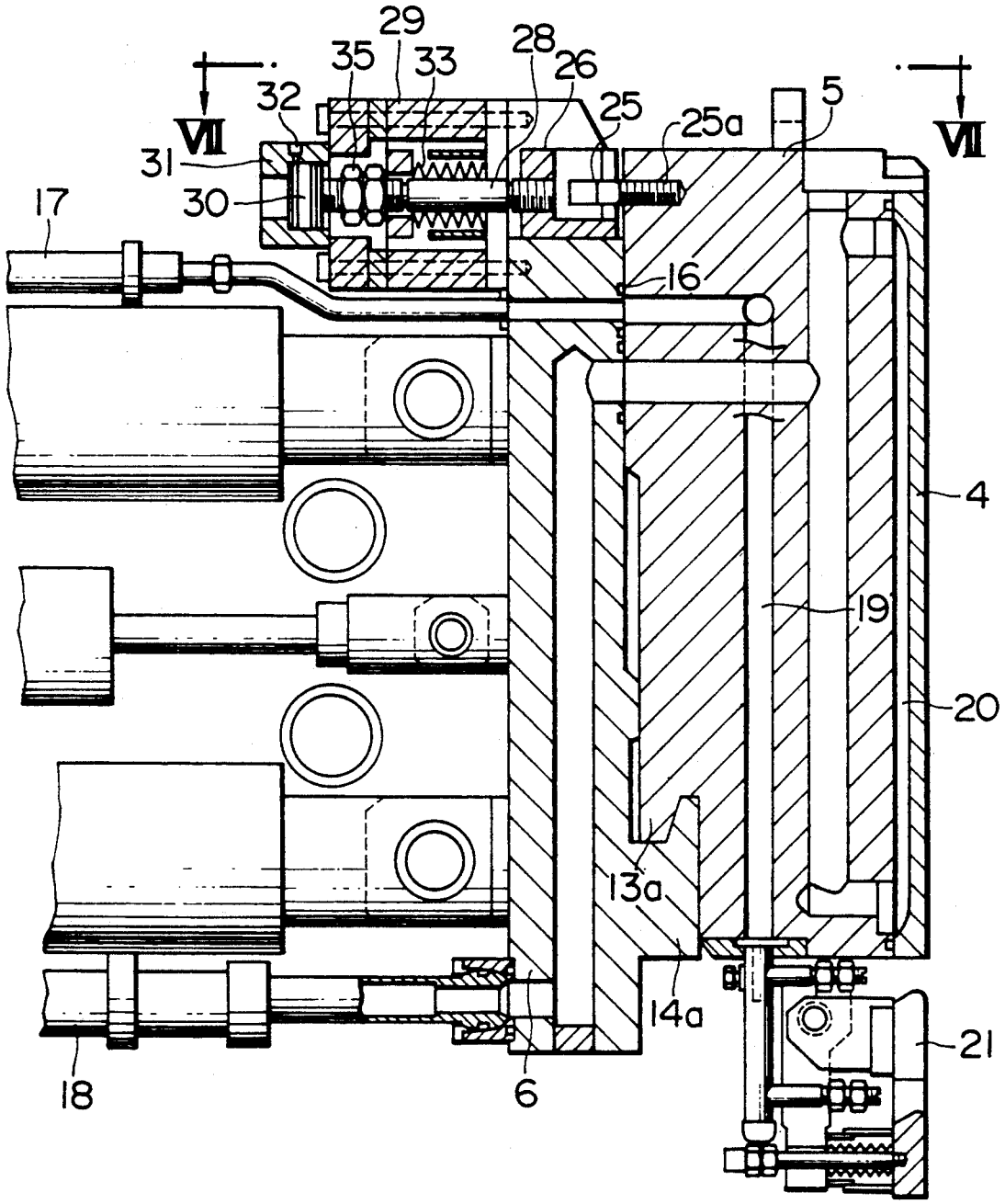
FIG. 5 is a cross-sectional view showing a second embodiment of the invention is which a variable lateral frame member is secured on a fixed lateral frame member.
Figure 6:
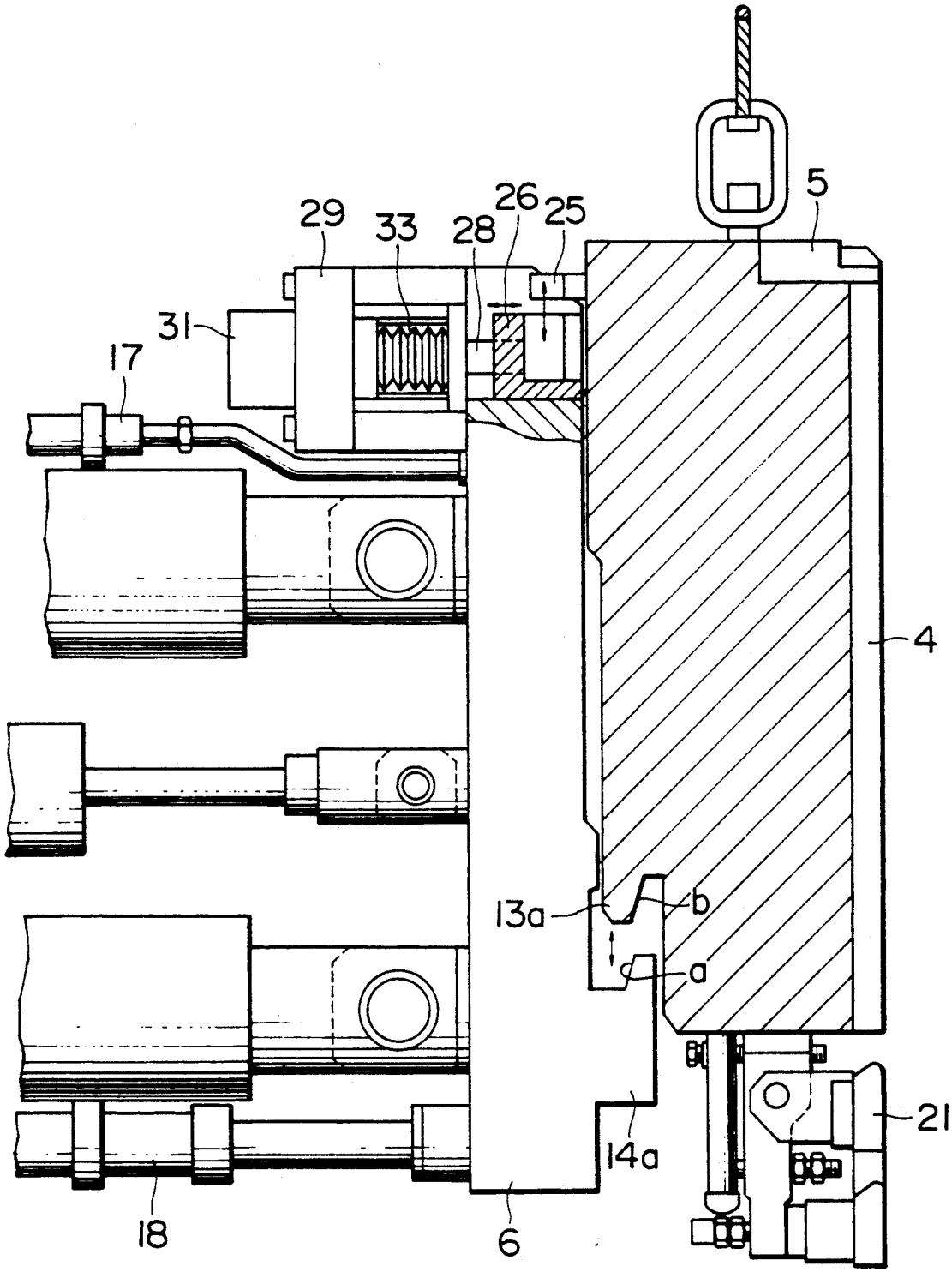
FIG. 6 is a view showing the second embodiment of the invention in which the variable lateral frame member is to be secured on the fixed lateral frame member.
Figure 7:
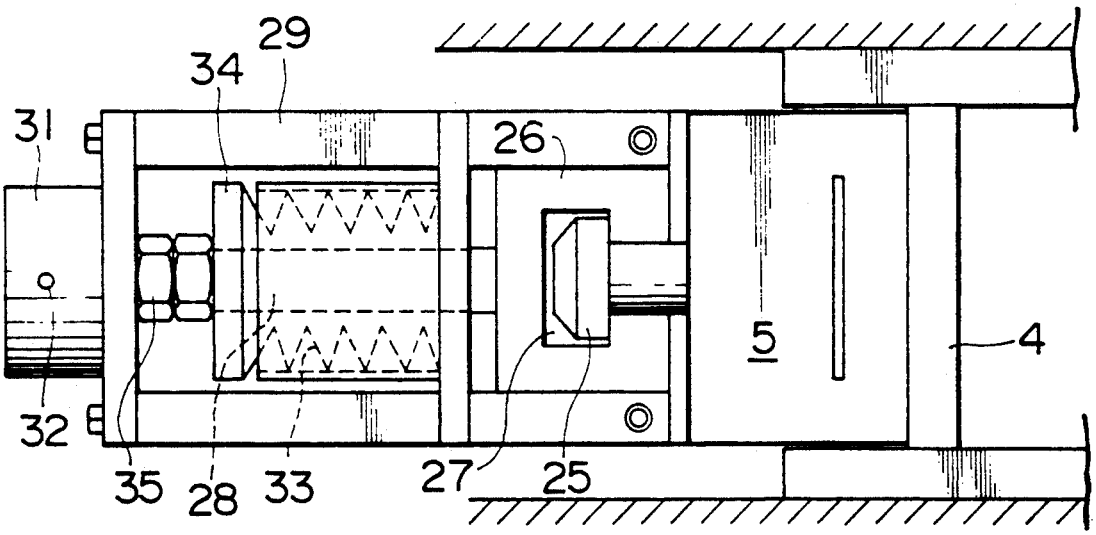
FIG. 7 is a partial, enlarged plan view taken along the line VII—VII of FIG. 5.

FIGS. 5 to 7 show a second embodiment of the invention: FIG. 5 is a cross-sectional view of a lateral frame; FIG. 6 is a view showing an assembling condition of a fixed frame member and a variable frame member; and FIG. 7 is a partial, enlarged view taken along the line VII—VII of FIG. 5.

The second embodiment is basically the same as the first one except for the structure of connection between the fixed frame member and the variable frame member. Therefore, differences will be mainly described below, and substantially the same component parts as those of the first embodiment will be denoted by common reference numerals so that their detailed descriptions may be omitted.

Referring to FIGS. 1 and 5 to 7, a bracket receiving recess 13*a* is provided in the lower portion of each of the variable lateral frame members 5. The bracket receiving recess 13*a* is a concave portion in the variable lateral frame member 5 in which a bracket to be described below can be fitted. The bracket receiving recess 13*a* is also formed with a taper surface b at the bottom in a manner similar to the above-described first embodiment.

A bracket 14*a* is provided on the lower portion of each of the fixed lateral frame member 6. The bracket 14*a* is projected toward the variable lateral frame member 5 and formed with a taper surface a at the top.

In other words, the bracket 14*a* and the bracket receiving recess 13*a* of the second embodiment are located in a reverse relation to those of the first embodiment. Therefore, in the second embodiment as well, when the variable lateral frame member 5 in a condition shown in FIG. 6 is moved down, the bracket 14*a* and the bracket receiving recess 13*a* are engaged with each other, and the taper surfaces a and b are slid and brought into contact with each other to thereby position the fixed lateral frame member 6 and the variable lateral frame member 5 accurately.

A large difference between the first and second embodiments is that the bolt holes 15*a* are formed in the upper portions of the fixed lateral frame members 6 and those of the variable lateral frame members 5 in the first embodiment, as described above, so that when the fixing bolt means 15 are forcibly inserted in the bolt holes 15*a*, the fixed lateral frame members 6 and the variable lateral frame members 5 are securely joined, but that fixing means of such bolt means 15 are displaced by the following structure in the second embodiment.

A projecting member 25 such as a T-shaped bolt means is forcibly inserted and secured in a bolt hole 25*a* formed in the upper portion of each of the variable lateral frame members 5. a slide block 26 is slidably provided on the top of each of the fixed lateral frame members 6. As shown in FIG. 7, a T-shaped recess 27, as viewed from above, is formed in the slide block 26. When the projecting member 25 is moved down and inserted into the T-shaped recess 27, they are engaged with each other so as not to be disengaged in the horizontal direction.

Also, a tie rod 28 is fixed on the side of the slide block 26 far from the variable lateral frame member 5.

The tie rod 28 is extended through a spring housing 29 which is secured on the upper portion of the side surface of the fixed lateral frame member 6, and also, a piston 30 is fixed on an end of the tie rod 28. A releasing cylinder 31 is secured on the spring housing 29, and the piston 30 is closely fitted in the cylinder 31. Reference numeral 32 denotes a pressure oil supply port.

A belleville spring 33 is provided in the spring housing 29 and fitted closely around the tie rod 28. Spring force of the belleville spring 33 is controlled by a spring force adjustment nut 35 through a spring receiving flange 34.

Therefore, in the set condition shown in FIG. 5, the variable lateral frame member 5 is secured on the fixed lateral frame member 6 through the tie rod 28, the slide block 26 and the projecting member 25 by tightening force produced from the spring force of the belleville spring 33 which is adjusted in advance.

On the other hand, in order to release the variable lateral frame member 5 from the fixed lateral frame member 6, pressure oil is supplied to the releasing cylinder 31, and the piston 30 is operated. Since the spring force of the belleville spring 33 is surpassed by the hydraulic pressure, the slide block 26 and the projecting member 25 can be displaced relatively so that when the variable lateral frame member 5 is lifted up, the fixed lateral frame member 6 and the variable lateral frame member 5 can be separated from each other.

The operations of the first and second embodiments will now be described. Referring to FIG. 1, in order to drive each of the worm jacks 11 in a direction for opening the movable longitudinal frame 2, pressure oil is first supplied from an oil supply port 24 to the plunger device 9 for releasing the clamping force, to thereby press down the plunger chamber 9*b* with respect to the piston 9*a*. Thus, the clamp spring 10 provided between the end cover 9*d* of the casing 9*c* and the flange 8*a* is compressed to remove the clamping force. Next, when the worm jack 11 is actuated by a driving apparatus such as a hydraulic motor and an electric motor although not shown, the tie rod 8 is moved down. An amount of this movement of the tie rod 8 is electrically detected by a synchro-transmitter or the like which is directly connected to the drive shaft, and the movement amount is controlled. Along with the movement of the tie rod 8, the movable longitudinal frame 2 which is substantially integral with the tie rod 8 is opened.

In this released condition, the fixing bolt means 15 shown in FIG. 2 is pulled out in the first embodiment, or the tightening force of the belleville spring 33 is removed by supplying pressure oil to the releasing cylinder 31 in the second embodiment.

After that, as shown in FIGS. 4 and 6, the variable lateral frame member 5 after use is detached, and a new variable lateral frame member 5 previously assembled with a lateral copper plate 4 and a foot shoe 21 is hung with a rope, inserted between the longitudinal frames 1 and 2 from above, and moved as indicated by arrows in the figure, so that the bracket 13, 14*a* will be engaged with the bracket receiving recess 14, 13*a*.

Then, contrary to the above-described manner, the fixing bolt means 15 is screwed in the first embodiment, or the pressure oil is drained out of the releasing cylinder 31 in the second embodiment. Thus, the fixed lateral frame member 6 and the variable lateral frame member 5 are integrally joined and fixed by the tightening force of the fixing bolt means 15 or the tightening force of the belleville spring 33. In consequence, the gap between these two frame members is sealed by the O-ring 16, and the water supply/drain pipe 18 and the spray water pipe 17 are connected with the water conduits 19 and 20 provided in the variable lateral frame member 5.

Next, when the worm jack 11 is driven in the closing direction, the tie rod 8 is moved in a direction for closing the movable longitudinal frame 2 contrary to the above-described direction until it is stopped with the variable lateral frame member 5 being clamped in position. In this condition, pressure oil is drained out of the plunger device 9 through its oil supply port 24. Then, the spring force of the clamp spring 10 whose clamping force has been removed by the plunger device 9 functions as a clamping force again (the spring 10 one end of which is supported on the tie rod 8 through the flange 8*a* functions to press the movable longitudinal frame 2 upwardly, as viewed in FIG. 1) in order to clamp the lateral copper plate 4 between the longitudinal copper plates 3 with a predetermined clamping force.

Figure 8:
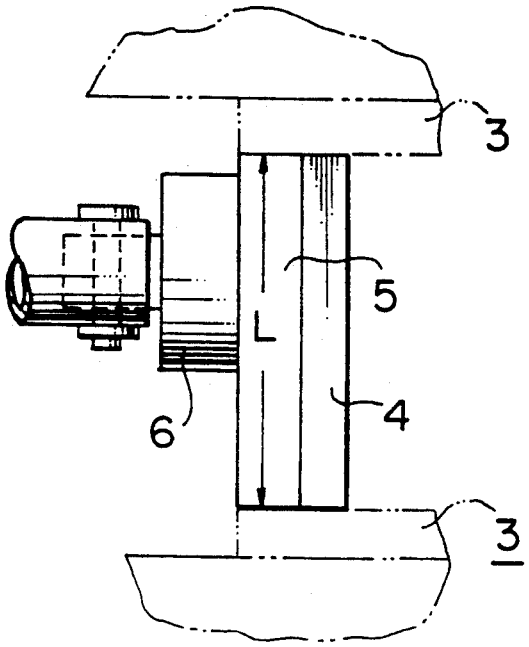
FIG. 8 is a view showing a relationship between a fixed lateral frame member and a variable lateral frame member in the case where a width L of the variable lateral frame member is large.
Figure 9:
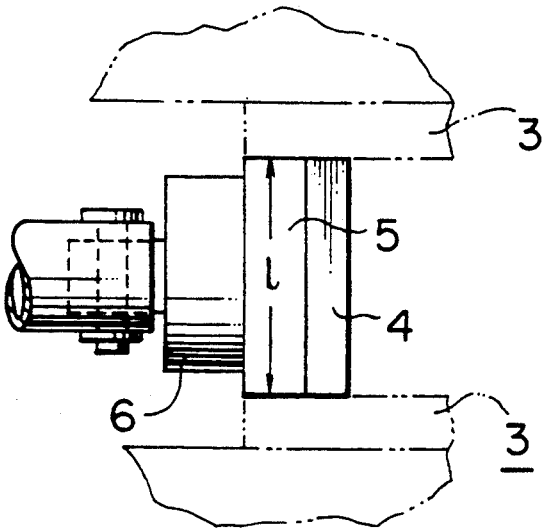
FIG. 9 is a view showing a relationship between a fixed lateral frame member and a variable lateral frame member in the case where a width ; of the variable lateral frame member is small.

In consequence, by replacing the variable lateral frame members 5 alone, the mold can be set as shown in FIG. 8 in the case where a width L of the frame members 5 is large, and the mold can be set as shown in FIG. 9 in the case where a width l of the frame members 5 is small. Either case can be dealt with when only the variable lateral frame members 5 are replaced.

In the two embodiments described above, there are illustrated with the cooling water conduits 19, 20 formed in the variable lateral frame members 5 and the water supply/drain pipes 17, 18 formed in the fixed lateral frame members 6 which are connected with and disengaged from each other at the frame contact surfaces. However, pipes projecting from the variable lateral frame members 5 may be detachably connected with the water supply/drain pipes on the side of the fixed lateral frame member by connector means such as couplers.

Also, in the above embodiments, the variable lateral frame members 5 and the fixed lateral frame members 6 are connected, at the lower portions, through engagements between the brackets 13, 14*a* and the bracket receiving recesses 14, 13*a*, and they are connected, at the upper portions, through connections between the bolt means 15 and the bolt holes 15*a* or connections through the tie rods by use of force of the springs 33 and hydraulic pressure. However, the variable lateral frame members 5 may be detachably connected to the fixed lateral frame members 6 only by bolt means and bolt holes (screw means).

The mold of the invention comprises the fixed longitudinal frame 1 and the movable longitudinal frame 2 which can be opened and closed by remote control, and the two lateral frames held between these longitudinal frames 1 and 2, and each of the lateral frames consists of the fixed lateral frame member 6 connected to the transfer device, and the variable lateral frame member 5 securely joined with the lateral copper plate 4 and detachably attached to the fixed lateral frame member 6. In consequence, quick replacement of the variable lateral frame members of the lateral frames alone can be performed by opening and closing the longitudinal frames without disassembling the machine so that the thickness of cast pieces can be changed easily and rapidly, thereby improving the operational efficiency. Also, since it is not necessary to replace the whole mold or the whole lateral frames as in the conventional technique, the cost can be reduced.

In the two embodiments described above, the variable lateral frame members are connected to the fixed lateral frame members through the tapered positioning brackets at the lower end portions and through the bolt means or the drawing devices with the hydraulic actuators at the upper end portions. Thrusts in the vertical directions are sustained by friction caused by the tightening forces. Further, the accuracy of the tapered positioning brackets serves to carry out positioning of the variable lateral frame members in the vertical directions.

However, it is feared that, when the friction between the cast piece and the copper plates during molding is increased, simple sustainment of the vertical thrusts by the tightening forces of the bolt means or the upper drawing devices becomes unstable. Moreover, when the accuracy of the tapered portions of the tapered brackets is deteriorated, there is caused a problem that the positions of the variable lateral frame members are displaced in the vertical directions. These problems can be solved by a third embodiment of the present invention which will be described below.

Figure 10:
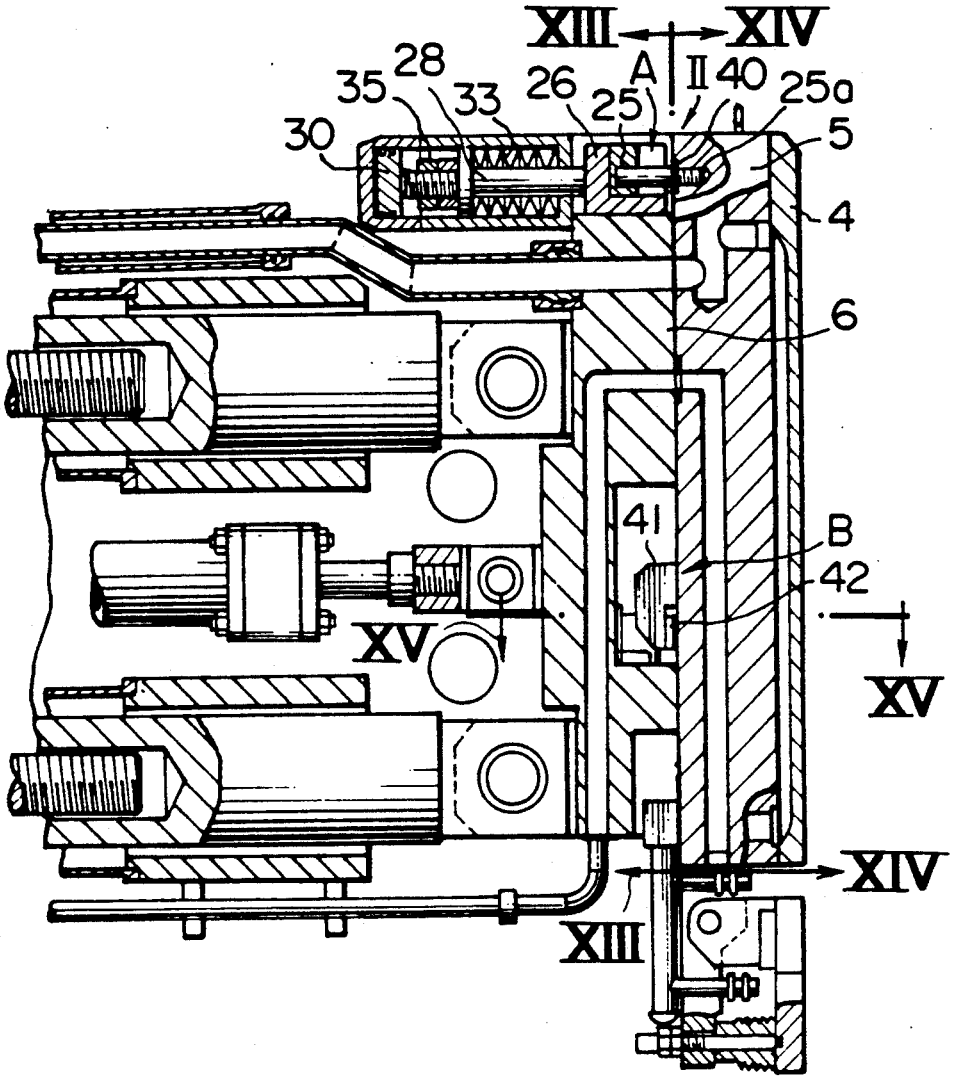
FIG. 10 is a cross-sectional view showing a third embodiment of the invention, with a variable lateral frame member being secured on a fixed lateral frame member.
Figure 11:
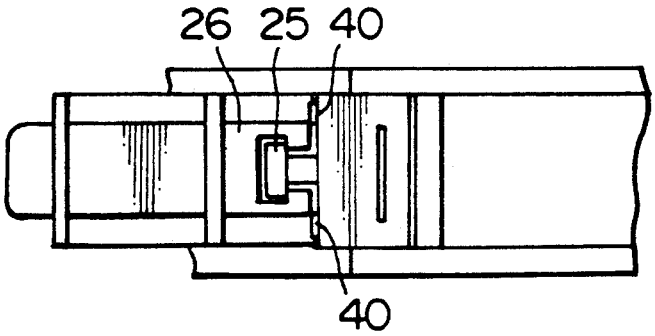
FIG. 11 is an enlarged plan view showing one portion of the device of FIG. 10, as viewed from above.
Figure 12:
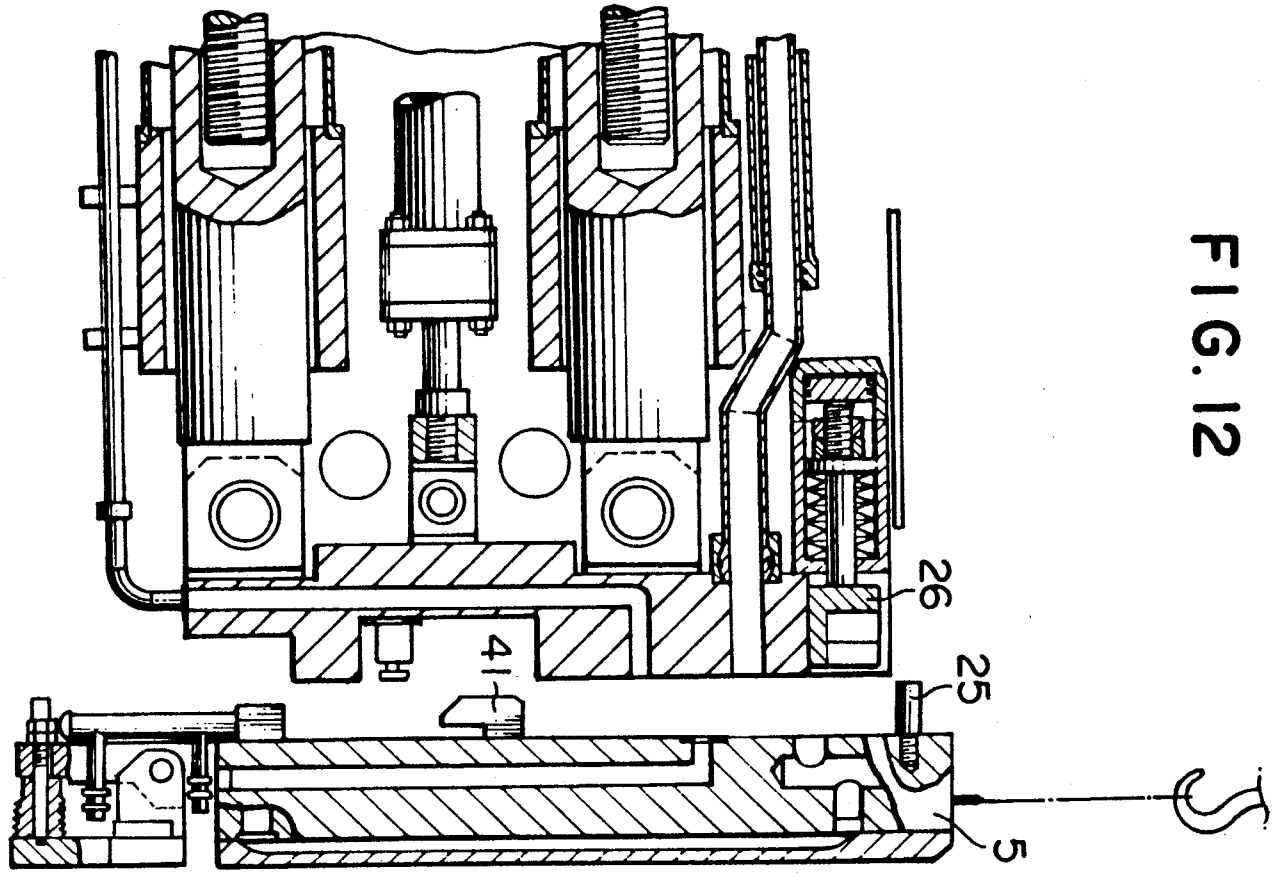
FIG. 12 is a diagram showing a condition of the device of FIG. 10 in which the variable lateral frame member is released.

FIG. 10 is a cross-sectional view showing a condition of a lateral frame member replacing device of the third embodiment when it is assembled, FIG. 11 is an enlarged plan view showing one portion of the device of FIG. 10, as viewed from above, and FIG. 12 is a cross-sectional view showing a condition of the device of FIG. 10 just before it is assembled.

In FIG. 10, reference numeral 25 denotes a block having a projecting member or a recess which constitutes an upper drawing device A. The projecting member is constituted by a T-shaped bolt means which is forcibly screwed into a bolt hole 25*a* of each of the variable lateral frame members 5. Reference numeral 26 denotes a slide block which is provided with a recess or a projecting member to be engaged with the projecting member or the recess of the above-mentioned block 25. In the same way as the second embodiment, a head of the T-shaped bolt means 25 is closely fitted in a T-shaped recess formed in the slide block 26. Reference numeral 33 denotes a tightening spring means constituted by a belleville spring. Reference numeral 28 denotes a tie rod integrally formed with the slide block 26, 35 denotes a nut for presetting the belleville spring, 30 denotes a releasing hydraulic piston, and 40 denotes a thrust receiving means.

Figure 14:
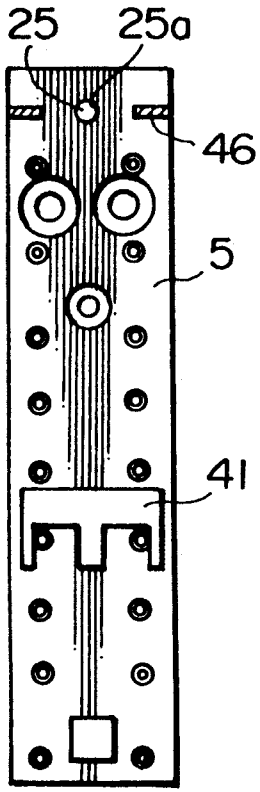
FIG. 14 is an end view of the variable lateral frame member, as viewed in a direction along the line XIIII—XIIII of FIG. 10.
Figure 13:
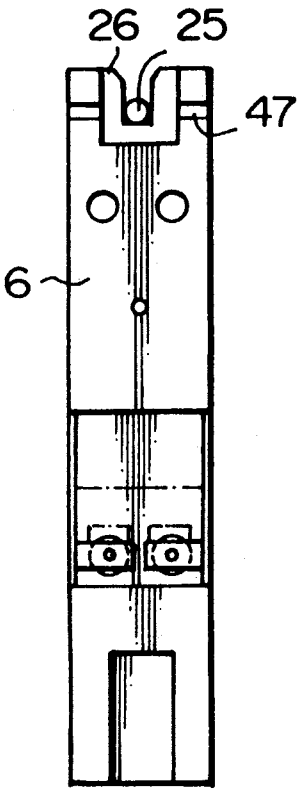
FIG. 13 is an end view of the fixed lateral frame member, as viewed in a direction along the line XIII—XIII of FIG. 10.

As shown in FIGS. 13 and 14, for example, the thrust receiving means 40 comprises a pair of left and right keys 46 provided o the variable lateral frame member 5, and a pair of key grooves 47 formed in the associated fixed lateral frame member 6.

Figure 15:
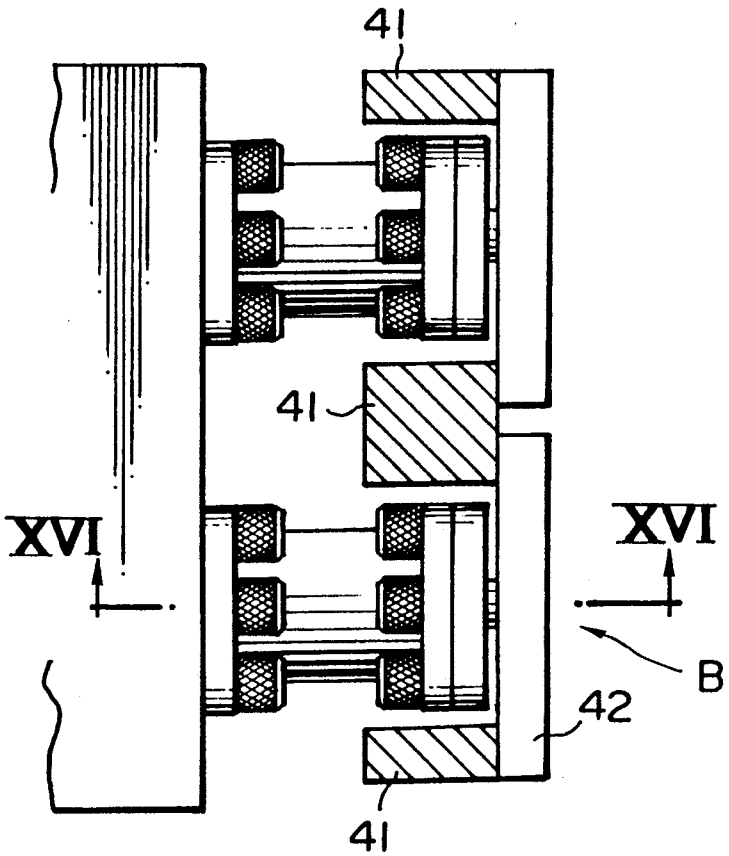
FIG. 15 is a cross-sectional view taken along the line XV—XV of FIG. 10, showing a lower drawing device in detail.
Figure 16:
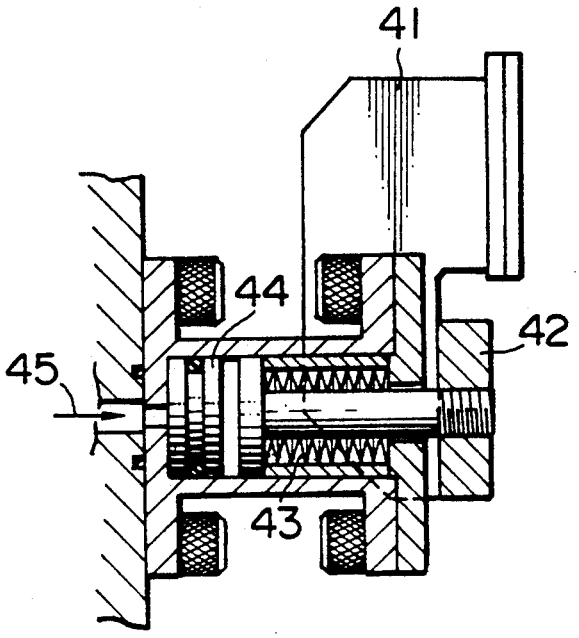
FIG. 16 is a cross-sectional view taken along the line XVI—XVI of FIG. 15, showing a condition in which a drawing plate is drawn.
Figure 17:
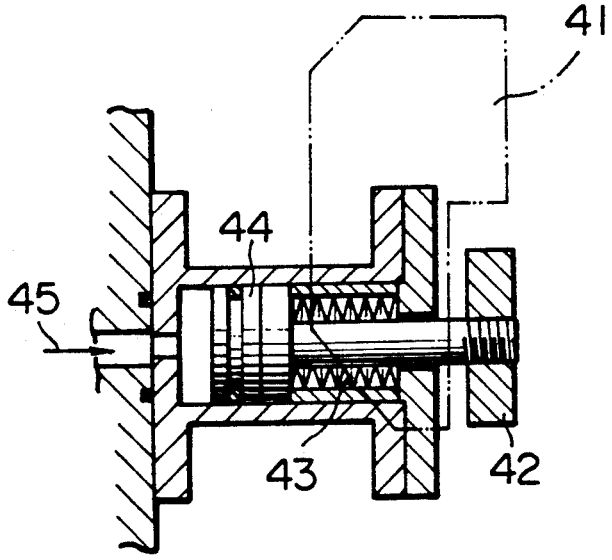
FIG. 17 is a cross-sectional view taken along the line XVI—XVI of FIG. 15, showing a condition in which the drawing plate is released.

FIG. 15 is a cross-sectional view taken along the line XV—XV of FIG. 10, showing a lower drawing device B in detail. FIG. 16 is a cross-sectional view taken along the line XVI—XVI of FIG. 15, showing an actuator in a clamping condition, while FIG. 17 shows the actuator in a non-clamping condition. In FIGS. 15 and 16, reference numeral 42 denotes a drawing plate for drawing and fastening a claw 41, and the drawing plate 42 is drawn by a spring means 43 (a belleville spring 43 in the figures). Reference numeral 44 denotes a piston. When the variable lateral frame member is released (unclamped), pressure oil 45 is supplied so that the piston compresses the belleville spring 43, thereby releasing the drawing plate 42.

As shown in FIG. 10, when pressure oil is supplied to the piston 30, the piston 30 is operated to press the belleville spring 33 toward the right side of the figure and compress it. Then, the slide block 26 is moved to the right, thus releasing the T-shaped bolt means 25 from the tightened condition.

Also, as shown in FIG. 17, when the pressure oil 45 is supplied to the piston 44, the piston 44 is operated to compress the belleville spring 43, and the drawing plate 42 is moved toward the right side of the figure. Then, the claw 41 is released from the tightening force. After that, as shown in FIG. 12, the variable lateral frame member 5 is lifted up and removed.

On the other hand, when a variable lateral frame member 5 of a different size is to be set, the pistons 30 and 44 are operated to release the upper and lower drawing devices A and B, and the new variable lateral frame member 5 is introduced from above, as shown in FIG. 12. The keys 46 and the key grooves 47 shown in FIGS. 13 and 14 are engaged with each other, to thereby effect the vertical positioning of the frame member. Next, when the operational pressure oil is drained from the pistons 30 and 44, the T-shaped bolt means 25 and the drawing plate 42 are drawn by the urging forces of the belleville springs 33 and 43, respectively, to thereby clamp the frame members.

In this embodiment, the upper drawing devices A and the lower drawing devices B are provided for tightening and securing the variable lateral frame members 5 on the fixed lateral frame members 6, and the respective hydraulic actuators enable their fastening/releasing operations. Therefore, no dangerous operation is involved, and the frame member replacement can be performed by remote control effectively.

Moreover, thrusts can be received by simple additional structures of the keys and the key grooves which also serve for the frame member positioning, so that the vertical positioning of the frame member can be effected reliably, and that sustainment of the vertical thrusts can also be conducted reliably.

What is claimed is:

1. An adjustable mold for continuous casting of articles of different thickness, comprising a fixed longitudinal frame, a movable longitudinal frame which is movable in the lateral direction with respect to said fixed longitudinal frame, a pair of lateral frames which are held between said fixed longitudinal frame and said movable longitudinal frame and located opposite to each other, each said lateral frame consisting of a fixed lateral frame member and a variable lateral frame member detachably attached on said fixed lateral frame member in surface contact relation with the latter, a device for moving each said fixed lateral frame member in the longitudinal direction, a bracket provided on one of said fixed lateral frame member and said variable lateral frame member to project from a lower portion of its contact surface, a bracket receiving recess formed in a lower portion of the contact surface of the other of said fixed lateral frame member and said variable lateral frame member to receive said bracket in engagement therewith, a projecting block located at an upper portion of the contact surface of said variable lateral frame member and having a first coupling portion, a slide block provided on said fixed lateral frame member and having a second coupling portion to be coupled with said first coupling portion of said projecting block, a piston connected to an end of a tie rod, the other end of which is connected to said slide block, hydraulic driving apparatus for pressing and moving said slide block toward said variable lateral frame member, and a spring device for biasing said tie rod in such a direction that said slide block is urged away from said variable lateral frame member.

2. An adjustable mold for continuous casting of articles of different thickness according to claim 1, wherein said first coupling portion of said projecting block is a projecting portion and said second coupling portion of said slide block is a recessed portion to be coupled with said projecting portion.

3. An adjustable mold for continuous casting of articles of different thickness according to claim 1 or 2, further including cooling water passages formed in said variable lateral frame members and water supply/drain pipes formed in said fixed lateral frame members, said cooling water passages and said water supply/drain pipes being designed to be connected/disengaged at the contact surfaces of said variable lateral frame member and said fixed lateral frame member.

4. An adjustable mold for continuous casting of articles of different thickness, comprising a fixed longitudinal frame, a movable longitudinal frame which is movable in the lateral direction with respect to said fixed longitudinal frame, a pair of lateral frames which are held between said fixed longitudinal frame and said movable longitudinal frame and located opposite to each other, each said lateral frame consisting of a fixed lateral frame member and a variable lateral frame member detachably attached on said fixed lateral frame member and securing thereon a lateral copper plate, a projecting block fixedly provided at an upper portion of said variable lateral frame member and having a first coupling portion, a slide block provided on said fixed lateral frame member and having a second coupling portion to be coupled with said first coupling portion of said projecting block, a hydraulically driven piston connected to an end of a tie rod, the other end of which is connected to said slide block, for pressing and moving said slide block toward said variable lateral frame member, a spring device for always biasing said tie rod in such a direction that said slide block is urged away from said variable lateral frame member, a claw securely fixed to said variable lateral frame member at a lower portion thereof, a drawing plate provided on said fixed lateral frame member to be movable toward and away from said fixed lateral frame member and adapted to be engaged by said claw, a second spring device for always urging said drawing plate toward said fixed lateral frame member, and a second hydraulically driven piston for pressing said drawing plate against said second spring device.

5. An adjustable mold for continuous casting of articles of different thickness according to claim 4 wherein said first coupling portion of said projecting block is a projecting portion and said second coupling portion of said slide block is a recessed portion to be coupled with said projecting portion.

6. An adjustable mold for continuous casting of articles of different thickness according to claim 4, further comprising a pair of thrust receiving means provided on opposite sides of said slide block.

7. An adjustable mold for continuous casting of articles of different thickness according to claim 6, wherein said pair of thrust receiving means include a pair of keys provided on said variable lateral frame member and a pair of key grooves provided on said fixed lateral frame member and arranged to mate with said keys.

* * * * *